US008072203B2

(12) United States Patent
Chen

(10) Patent No.: US 8,072,203 B2
(45) Date of Patent: Dec. 6, 2011

(54) METHOD AND APPARATUS FOR REGULATING ELECTRICAL POWER FROM A NON-PERPETUAL POWER SOURCE

(76) Inventor: Marcellus Chen, Fremont, CA (US)

( * ) Notice: Subject to any disclaimer, the term of this patent is extended or adjusted under 35 U.S.C. 154(b) by 1024 days.

(21) Appl. No.: 11/956,281

(22) Filed: Dec. 13, 2007

(65) Prior Publication Data

US 2009/0153107 A1 Jun. 18, 2009

(51) Int. Cl.
*G05F 1/00* (2006.01)

(52) U.S. Cl. ..... 323/284; 363/19; 363/21.01

(58) Field of Classification Search ..... 363/35, 363/36, 37, 52, 19, 21.01; 323/222, 224, 323/234, 271, 282, 283, 284, 285
See application file for complete search history.

(56) References Cited

U.S. PATENT DOCUMENTS

| | | | | |
|---|---|---|---|---|
| 6,556,462 | B1 * | 4/2003 | Steigerwald et al. | 363/89 |
| 6,967,851 | B2 * | 11/2005 | Yang et al. | 363/16 |
| 7,265,524 | B2 * | 9/2007 | Jordan et al. | 323/225 |
| 7,834,580 | B2 * | 11/2010 | Haines | 320/101 |
| 2003/0007369 | A1 * | 1/2003 | Gilbreth et al. | 363/35 |
| 2004/0252532 | A1 * | 12/2004 | Lee et al. | 363/89 |

* cited by examiner

*Primary Examiner* — Adolf Berhane
*Assistant Examiner* — Nguyen Tran
(74) *Attorney, Agent, or Firm* — Patterson & Sheridan, LLP

(57) ABSTRACT

A method and system for regulating electrical power from a non-perpetual power source. In one implementation, the method includes receiving a variable power output from the non-perpetual power source, wherein a power amplitude of the variable power output substantially varies over time; and generating a regulated current output or a regulated voltage output based in part on the variable power output received from the non-perpetual power source.

19 Claims, 12 Drawing Sheets

METHOD AND APPARATUS FOR REGULATING ELECTRICAL POWER FROM A NON-PERPETUAL POWER SOURCE

FIELD OF THE INVENTION

This disclosure relates generally to electrical circuits, and more particularly to techniques for regulating electrical power from a non-perpetual power source.

BACKGROUND OF THE INVENTION

Perpetual power sources generally provide time invariant power which can be used to supply electrical power to electronic devices. Examples of perpetual power sources include electrical outlets (or wall sockets), batteries, and the like. Electronic devices typically include a power controller (e.g., a power regulator) that regulates power from a perpetual power source to the electronic devices. FIG. 1 illustrates a conventional electronic system 100 including electronic devices 102, 104 that are powered by perpetual power sources. In particular, the electronic device 102 is powered from an electrical outlet 106 and receives regulated power through a power regulator 108, and the electronic device 104 is powered from a rechargeable battery 110 and receives regulated power through a power regulator 112. The electrical outlet 106 further provides power to a battery charger 114 to charge the rechargeable battery 110. The power regulator 108 and the battery charger 114 can receive electrical power from the electrical outlet 106 through an AC to DC converter 118.

In general, conventional power controllers—e.g., power regulator 108, 112, and battery charger 114—are designed only to operate based on a perpetual power source. Note: batteries (rechargeable and non-chargeable) are considered to be perpetual sources as batteries substantially maintain a constant voltage output until depletion. For example, FIG. 1B shows a graph 116 that depicts the power amplitude of an output of the electrical outlet 106 and the rechargeable battery 108. As shown in the graph 116, the power amplitude of the output of both the electrical outlet 106 and the rechargeable battery 110 are substantially constant over time. Conventional power controllers cannot generally operate if a perpetual power source is not present within an electronic system.

SUMMARY OF THE INVENTION

In general, in one aspect, this specification describes a method for regulating electrical power from a non-perpetual power source. The method includes receiving a variable power output from the non-perpetual power source, wherein a power amplitude of the variable power output substantially varies over time; and generating a regulated current output or a regulated voltage output based in part on the variable power output received from the non-perpetual power source.

Implementations can include one or more of the following features. The non-perpetual power source can comprise one or more of an energy receiver, a light energy converter system, a physical motion energy-to-power converter system, or a heat energy-to-power converter system. Generating a regulated current output or a regulated voltage output can further comprise generating a regulated current output or a regulated voltage output based in part on a voltage amplitude associated with the regulated current output or the regulated voltage output. The method can further include receiving a non-varying power output from a perpetual power source, and generating a regulated current output or a regulated voltage output can include generating a regulated current output or a regulated voltage output also based in part on the non-varying power output from the perpetual power source. The perpetual power source can comprise one or more of an electrical outlet or a battery. The method can further include providing the regulated current output or the regulated voltage output to an electronic device function. The electronic device function can comprise a component of an electronic device that requires power to operate. The component can comprise an analog-to-digital converter, a switching regulator, a linear regulator, a power amplifier, or a transceiver.

The method can further include receiving a control signal from the electronic device function, and generating a regulated current output or a regulated voltage output can include generating a regulated current output or a regulated voltage output also based in part on the control signal from the electronic device function. The method can further include calculating a total amount or a partial amount of power being consumed based on the variable power output from the non-perpetual power source; and providing the total amount or the partial amount of power being consumed to the electronic device function. The method can further include comparing a voltage amplitude of the variable power output from the non-perpetual power source with a predetermined threshold voltage; and in response to the voltage amplitude of the variable power output being greater than the predetermined threshold voltage, directing electrical current from the non-perpetual power source to ground (GND) to lower the voltage amplitude of the variable power output below the predetermined threshold voltage. The method can further include comparing a voltage amplitude of the variable power output from the non-perpetual power source with a predetermined under voltage; and in response to the voltage amplitude of the variable power output being lower than the predetermined under voltage, ceasing to generate the regulated current output or the regulated voltage output. The method can further include storing electrical charge associated with the variable power output from the non-perpetual power source in a capacitor. Generating a regulated current output or a regulated voltage output can comprise safely ramping up the regulated current output or the regulated voltage output.

In general, in another aspect, this specification describes an electronic system that includes a non-perpetual power source configured to generate a variable power output, wherein a power amplitude of the variable power output substantially varies over time; and a power controller configured to generate a regulated current output or a regulated voltage output based in part on the variable power output received from the non-perpetual power source.

Implementations can include one or more of the following features. The power controller can comprise one or more of a current regulator, a voltage regulator, or a battery charger. The electronic system can further include a perpetual power source configured to generate a non-varying power output, and the power controller can be further configured to generate a regulated current output or a regulated voltage output based in part on the non-varying power output from the perpetual power source. The power controller can be integrated onto an integrated circuit (IC) module including one of an analog-to-digital converter, a switching regulator, a linear regulator, a power amplifier, or a transceiver.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF THE INVENTION

This disclosure relates generally to electrical circuits, and more particularly to techniques for regulating electrical power from a non-perpetual power source. The following description is presented to enable one of ordinary skill in the art to make and use the invention and is provided in the context of a patent application and its requirements. The present invention is not intended to be limited to the implementations shown but is to be accorded the widest scope consistent with the principles and features described herein.

Figure 1A:
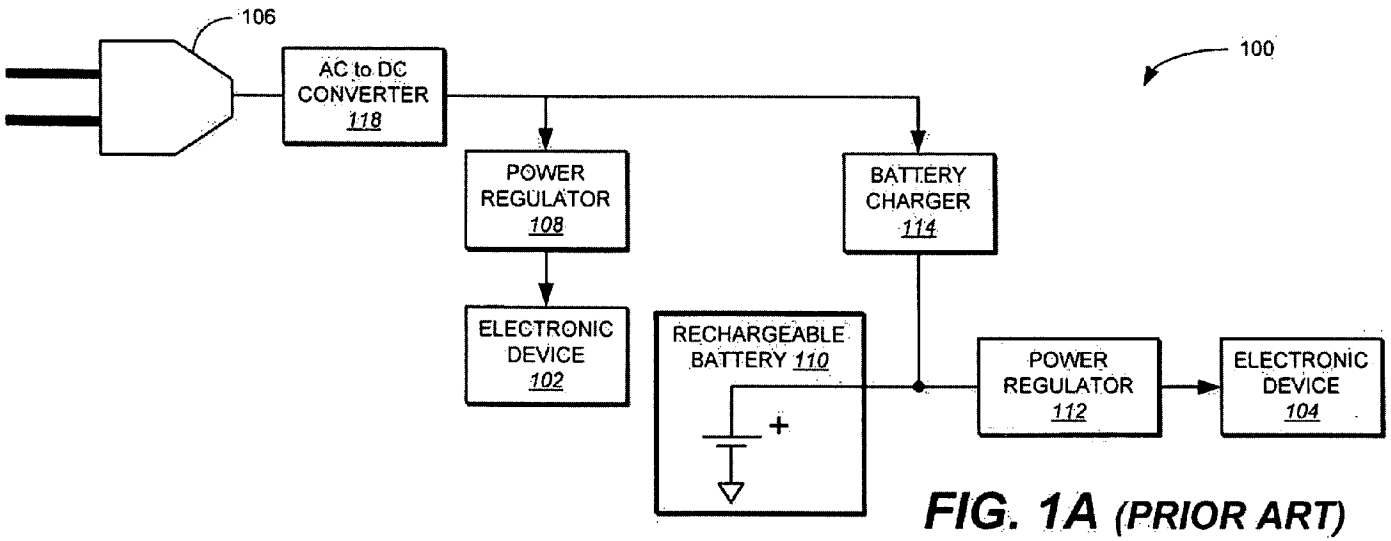
FIG. 1A (PRIOR ART)
FIG. 1A is a block diagram of a conventional electronic system including perpetual power sources.
Figure 1B:
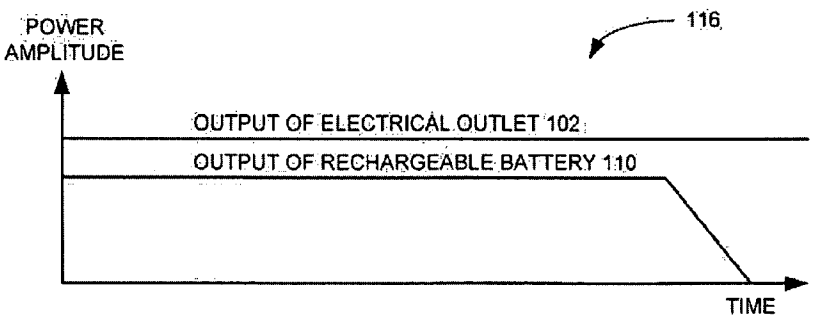
FIG. 1B (PRIOR ART)
FIG. 1B illustrates a graph of output power amplitudes of the perpetual power sources of FIG. 1A.
Figure 2A:
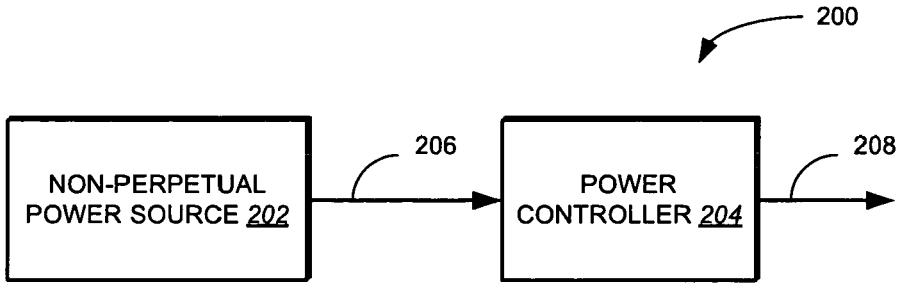
FIG. 2A is a block diagram of an electronic system including a non-perpetual power source in accordance with one implementation.

FIG. 2A illustrates one implementation of an electronic system 200 including a non-perpetual power source 202 and a power controller 204. The non-perpetual power source 202 can be any type of power source that generates an output (e.g., output 206) having a variable output power amplitude—e.g., an energy receiver (as described in application Ser. No. 11/857,655, filed on Sep. 19, 2007, which is incorporated herein by reference), a light energy (or solar energy) converter system, a physical motion energy-to-power converter system, a heat energy-to-power converter system, and so on. For example, a power output of an energy receiver can vary based on whether communication devices are turned on or off, and based on the varying power level of transmitted signals; a power output of a solar energy converter system can vary based on clouds in the sky; a power output of a physical motion energy-to-power converter system can vary based varying speeds of motion; and a power output of a heat energy-to-power converter system can vary based on changing temperatures.

Figure 2B:
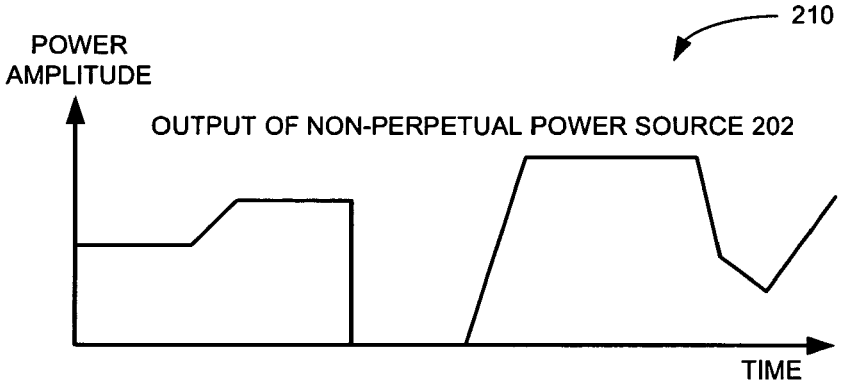
FIG. 2B illustrates a graph of output power amplitude of the non-perpetual power source of FIG. 2A.

FIG. 2B illustrates a graph 210 that shows an example variation of the power amplitude of the non-perpetual power source 202 over time. As shown in the graph 210, the output power amplitude of the non-perpetual power source 202 substantially varies over time and even decreases to zero. In one implementation, the power controller 204 is configured to generate a regulated power output 208—e.g., a regulated current output and/or a regulated voltage output—that can be provided to an electronic device or a conventional power controller. In one implementation, the power controller 204 continuously monitors the power level output from the non-perpetual power source 202, as well as the electrical power requirement of any connected electrical devices (or other power controllers), to provide smooth operation (and protection) for the connected electrical devices or other power controllers. In one implementation, the power controller 204 is programmable in that the power controller 204 can provide one of a regulated current output, a regulated voltage output, or both a regulated current output and a regulated voltage output based on a setting of a configuration bit. The power controller 204 can be a power regulator, a battery charger, or other type of power controller.

Figure 3:
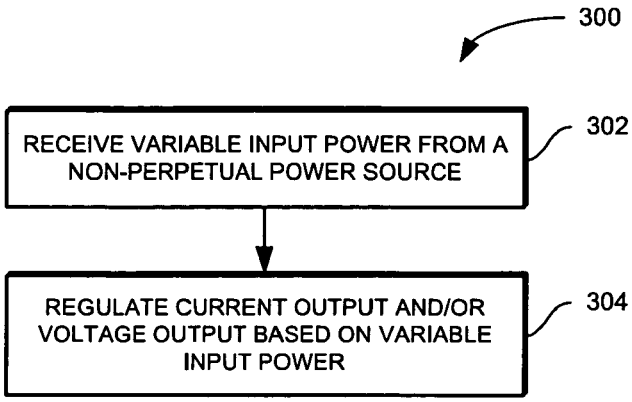
FIG. 3 depicts a method for regulating power from non-perpetual power source in accordance with one implementation.

FIG. 3 illustrates a method 300 for regulating electrical power from non-perpetual power source (e.g., non-perpetual power source 202). A variable input power is received from the non-perpetual power source (step 302). As discussed above, the non-perpetual source can be, for example, an energy receiver, a light energy converter system, a physical motion energy-to-power converter system, a heat energy-to-power converter system, and so on. The variable input power can comprise a variable input current and/or a variable input voltage. A regulated current output and/or a regulated voltage output is generated (e.g., through power controller 204) based on the variable input power received from the non-perpetual power source (step 304). The regulated current output and/or the regulated voltage output can be provided to an electronic device and/or a conventional power controller.

Figure 4A:
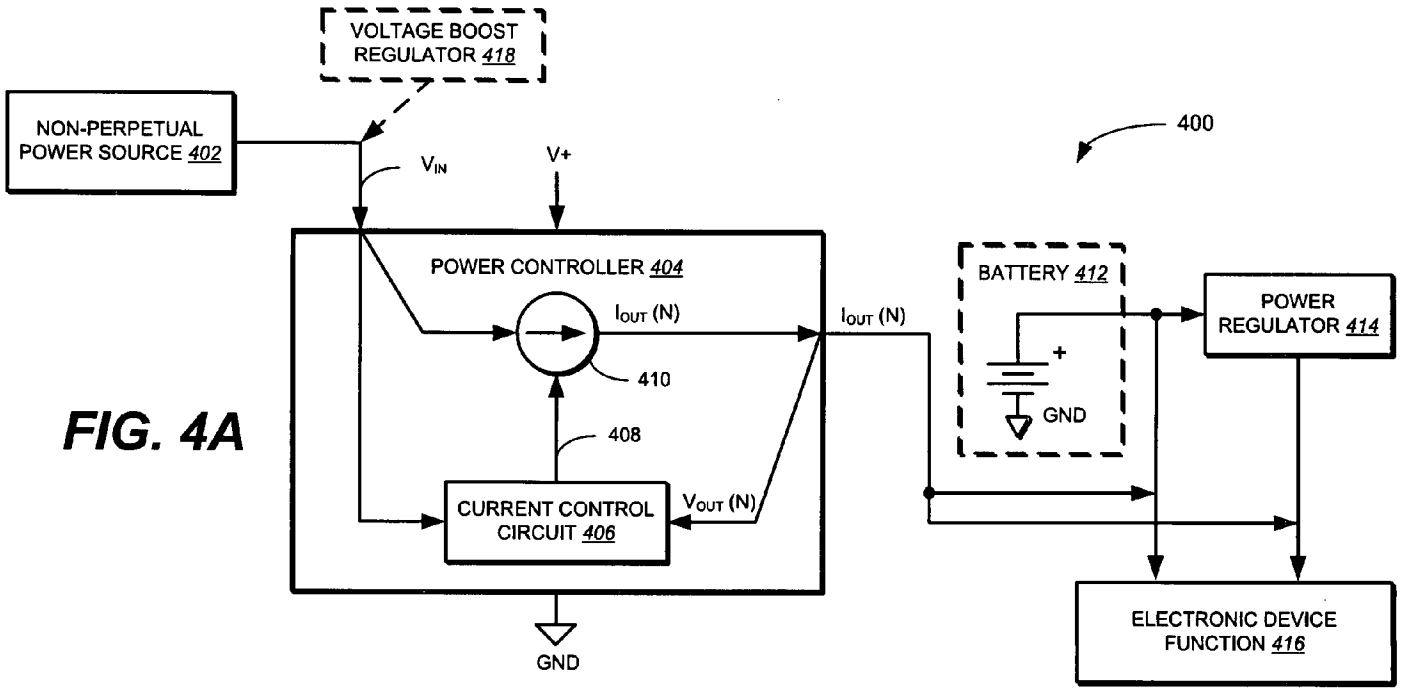
FIG. 4A is a block diagram of an electronic system including a non-perpetual power source in accordance with one implementation.

FIG. 4A illustrates one implementation of an electronic system 400 including a non-perpetual power source 402 and a power controller 404. In the implementation of FIG. 4A, the power controller 404 is configured to generate a regulated output current $I_{OUT}(N)$ based on a variable input voltage $V_{IN}$ received from the non-perpetual power source 402 and an output voltage $V_{OUT}(N)$ of the power controller 404. Specifically, (in one implementation) the power controller 404 includes a current control circuit 406 that generates a control signal 408 based on variable input voltage $V_{IN}$ and output voltage $V_{OUT}(N)$. The control signal 408 is, in turn, provided to a current source 410 that generates the regulated output current $I_{OUT}(N)$. The regulated output current $I_{OUT}(N)$ can be provided to an output of a battery 412 or an output of a power regulator 414 to reduce the load on the battery 412 and/or the power regulator 414 as required by an electronic device function 416. The electronic device function 416 can be any component of an electronic device that requires power to operate. Thus, by connecting the regulated output current $I_{OUT}(N)$ to an output of the battery 412, the operation time of the battery 412 can be extended. In one implementation in which the battery 412 is a rechargeable battery, the reduction in load on the battery 412 will reduce the frequency in which the battery 412 has to be recharged and, therefore, extend the life of the battery 412.

Figure 4B:
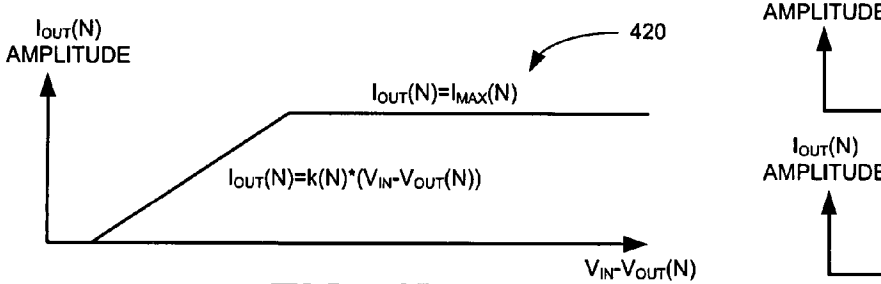
FIG. 4B illustrates a graph of the amplitude of a current output from the power controller of FIG. 4A.

In one implementation, the power controller 404 is coupled to a positive supply voltage V+ and a negative supply voltage GND. The positive supply voltage V+ can be merged with the variable input voltage $V_{IN}$. Although the regulated output current $I_{OUT}(N)$ is shown as a single regulated output, the power controller 404 can generate a plurality of regulated output currents. Likewise, the output voltage $V_{OUT}(N)$ can represent one or more output voltages that correspond to a regulated output current $I_{OUT}(N)$. In one implementation, the regulated output current $I_{OUT}(N)$ is dependent upon a voltage amplitude value the variable input voltage $V_{IN}$ and the output voltage $V_{OUT}(N)$ (or $V_{IN}-V_{OUT}(N)$) as follows:

$$\text{if } V_{IN}-V_{OUT}(N)>V_{ON}(N), \text{ then } I_{OUT}(N)=k(N)*(V_{IN}-V_{OUT}(N)), \quad \text{(eq. 1)}$$

$$\text{if } V_{IN}-V_{OUT}(N)>V_{ON}(N), \text{ then } I_{OUT}(N) \text{ is limited to } I_{MAX}(N), \quad \text{(eq. 2)}$$

$$\text{if } V_{IN}-V_{OUT}(N)<V_{ON}(N), \text{ then } I_{OUT}(N)=0, \quad \text{(eq. 3)}$$

where k(N) is one or more factors that can be optimized based on application requirements—e.g., $I_{OUT}(N)=0.1$ A/V * (3V−2V)=0.1 A, $V_{ON}(N)$ is one or more threshold voltages so that $I_{OUT}(N)=0$ can be properly set based on application requirements, and $I_{MAX}(N)$ is one or more pre-determined safety current limits to prevent too much current from being sent to, e.g., an electronic device and/or power regulator. FIG. 4B is a graph 420 that depicts the amplitude of the regulated output current $I_{OUT}(N)$ as a function of the variable input voltage $V_{IN}$ and the output voltage $V_{OUT}(N)$.

Thus, in one implementation, the regulated output current $I_{OUT}(N)$ is continuously controlled based on the variable input voltage $V_{IN}$ and the output voltage $V_{OUT}(N)$. In one implementation, if the amplitude of the variable input voltage $V_{IN}$ is too low, then the regulated output current $I_{OUT}(N)$ is shut down. Because the power controller 404 is a current regulator, the output voltage $V_{OUT}(N)$ can comply (or be equal to) voltages present at the output of the battery 412 and/or the power regulator 414 (without requiring additional circuitry). Further, in one implementation, if the amplitude of the variable input voltage $V_{IN}$ is lower than the output voltage $V_{OUT}(N)$, the power controller 404 can optionally be connected to a voltage boost regulator 418 to boost the variable input voltage $V_{IN}$ to a voltage that is higher than the output voltage $V_{OUT}(N)$. The voltage boost regulator 418 can be a conventional inductor-based or capacitor-based switching regulator. The voltage boost regulator 418 can be integrated into the power controller 404 or be separate from the power controller 404.

Figure 4C:
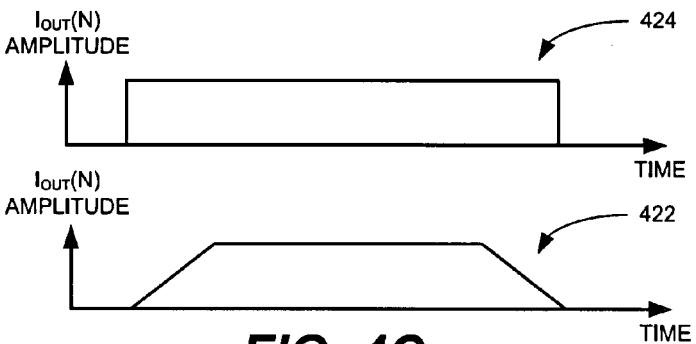
FIG. 4C illustrates a ramp up of the current output from the power controller of FIG. 4A in accordance with one implementation.

In one implementation, the amplitude of the regulated output current $I_{OUT}(N)$ is designed to slowly ramp up and down respectively during startup and shut down sequences (as shown in graph 422 of FIG. 4C). Some electrical devices (or functions thereof) may be damaged or be non-functional if the amplitude of the regulated output current $I_{OUT}(N)$ ramps up and down too fast (as shown in graph 424 of FIG. 4C). Therefore, factors that should be considered when designing the ramp up and ramp down speed of the regulated output current $I_{OUT}(N)$ should include behaviors of, e.g., a connected battery, power regulator, and/or electronic device.

Figure 5:
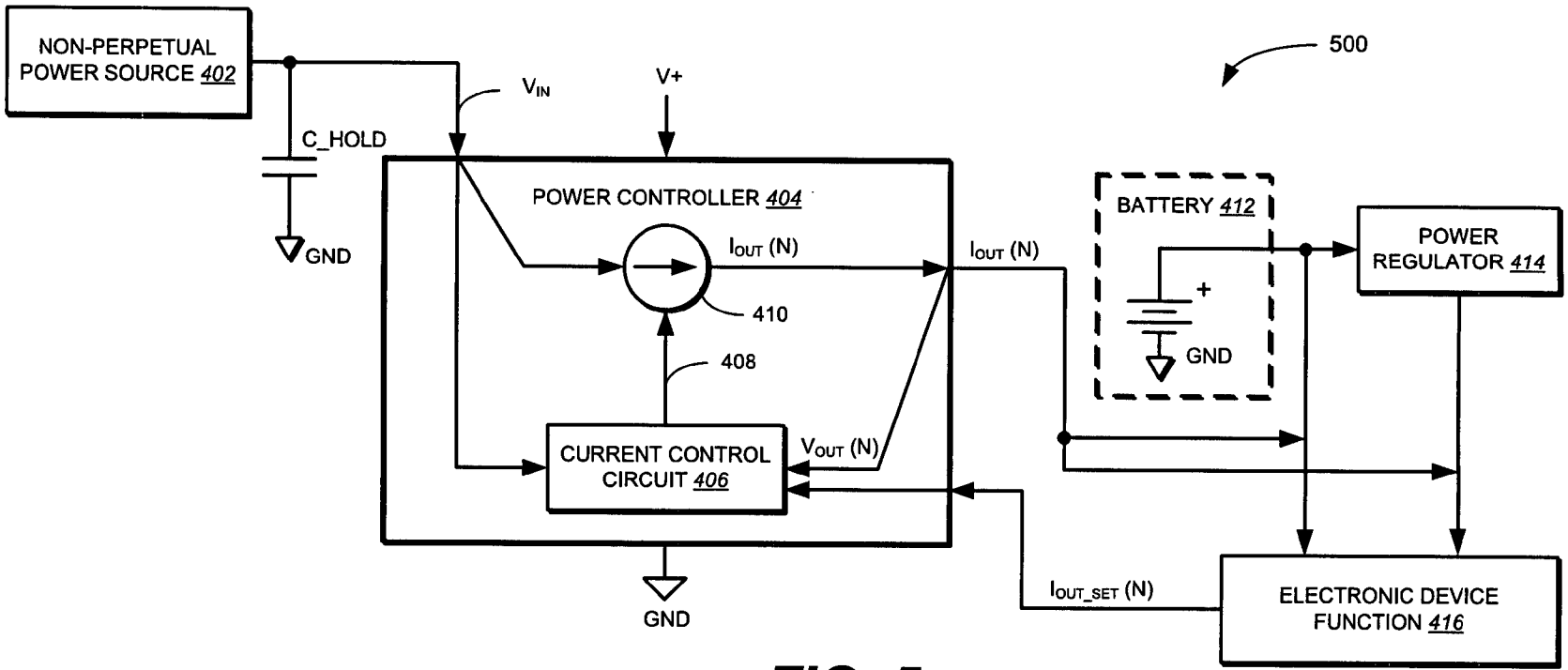
FIG. 5 is a block diagram of an electronic system including a non-perpetual power source in accordance with one implementation.

FIG. 5 illustrates one implementation of an electronic system 500 including non-perpetual power source 402 and power controller 404. In the implementation shown in FIG. 5, the regulated output current $I_{OUT}(N)$ is further controlled by an input signal that is external to the power controller 404—i.e., external input signal $I_{OUT_SET}(N)$. In one implementation, the external input signal $I_{OUT_SET}(N)$ can be a signal that is dynamically generated based on, e.g., changing current requirements of the electronic device function 416. In one implementation, the external input signal $I_{OUT_SET}(N)$ can determine an amplitude of the regulated output current $I_{OUT}(N)$ as follows:

$$I_{OUT}(N) \Leftarrow I_{OUT_SET}(N), \quad \text{(eq. 4).}$$

In this implementation, equation 4 can take precedence over equations 1 and 2 in determining the amplitude for the regulated output current $I_{OUT}(N)$. For example, if the electronic device function 416 requires only 10 mA and $I_{OUT}(N)=k(N) * (V_{IN}-V_{OUT}(N))=50$ mA, then the additional 40 mA can be stored (e.g., in a capacitor $C_{HOLD}$) to avoid damaging the electronic device function 416. The external input signal $I_{OUT_SET}(N)$ can be an analog and/or digital representation of a target output current amplitude value for the regulated output current $I_{PUT}(N)$. Although the external input signal $I_{OUT_SET}(N)$ is shown as a single input signal, the external input signal $I_{OUT_SET}(N)$ can represent a plurality of input signals to the current control circuit 406.

Figure 6A:
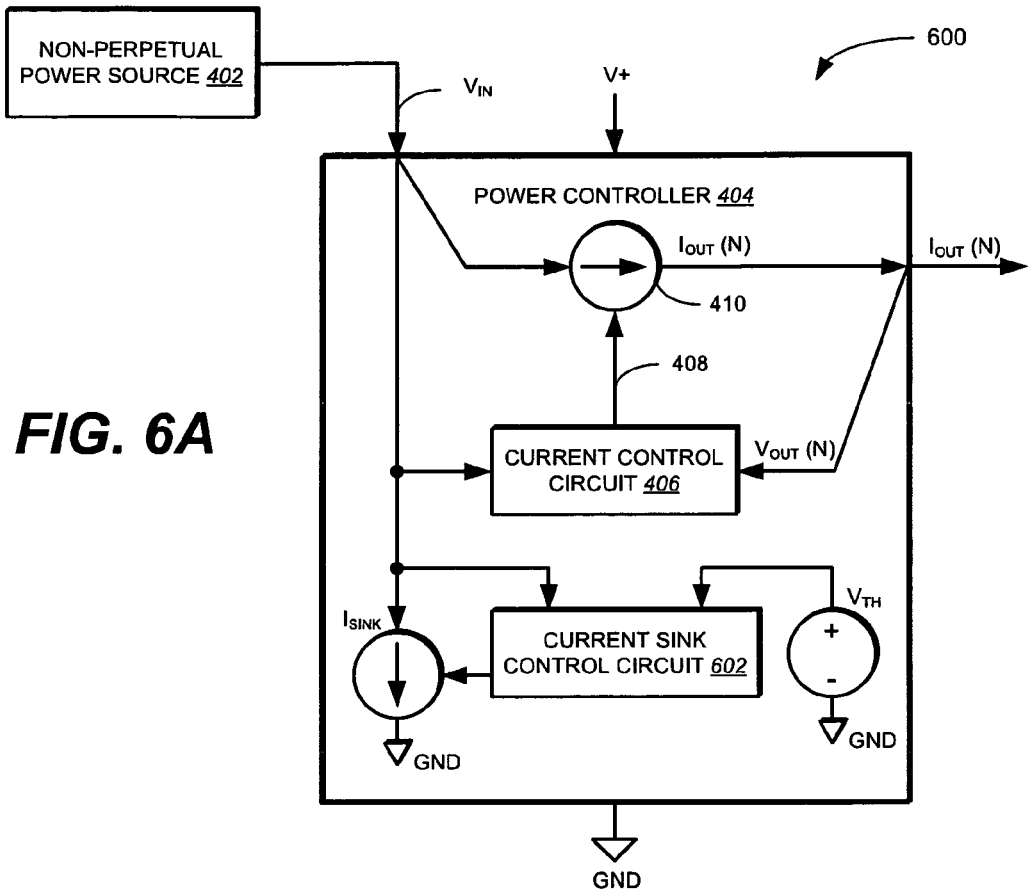
FIG. 6A is a block diagram of an electronic system including a power controller having a current source sink in accordance with one implementation.
Figure 6B:
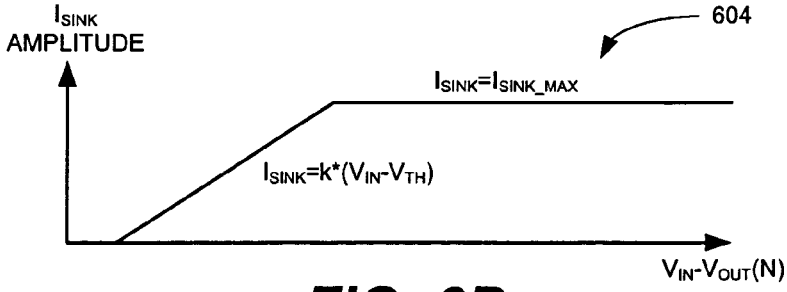
FIG. 6B illustrates a graph of an output of the current source sink of FIG. 6A.

FIG. 6A illustrates one implementation of an electronic system 600 including non-perpetual power source 402 and power controller 404. In the implementation of FIG. 6A, the power controller 404 includes over voltage protection to protect the power controller 404 from excess voltage at the input. In one implementation, the over voltage protection comprises a current sink control circuit 602, reference voltage $V_{TH}$, and current source sink $I_{SINK}$. In one implementation, the reference voltage $V_{TH}$ represents a pre-determined maximum safe voltage level that can be handled by the power controller 404, and the current sink control circuit 602 compares the reference voltage $V_{TH}$ to the variable input voltage $V_{IN}$, and operates as follows. If $V_{IN}>V_{TH}$, then the current sink control circuit 602 will turn on the current source sink $I_{SINK}$ to safely direct electrical current at the input voltage $V_{IN}$ to ground (GND) (thereby lowering the amplitude of $V_{IN}$ below that of $V_{TH}$). In one implementation, the current source sink $I_{SINK}$ is designed to be a function of the variable input voltage $V_{IN}$ and the reference voltage $V_{TH}$ (or $V_{IN}-V_{TH}$) as follows:

$$I_{SINK}=k*(V_{IN}-V_{TH}), \text{ if } V_{IN}>V_{TH} \quad \text{(eq. 5),}$$

where k is a predetermined factor based on application requirements. In one implementation, the amplitude of the current source sink $I_{SINK}$ is designed to be limited to sink a pre-determined maximum current $I_{SINK_MAX}$ as shown in the graph 604 of FIG. 6B. The current source sink $I_{SINK}$ generally dissipates power at the input of the power controller 404 so that the voltage $V_{IN}$ decreases to protect the power controller 404. In one implementation, the current source sink $I_{SINK}$ is designed to be variable so that the current source sink $I_{SINK}$ dissipates enough power so that the input voltage $V_{IN}$ substantially equals the reference voltage $V_{TH}$.

Figure 7:
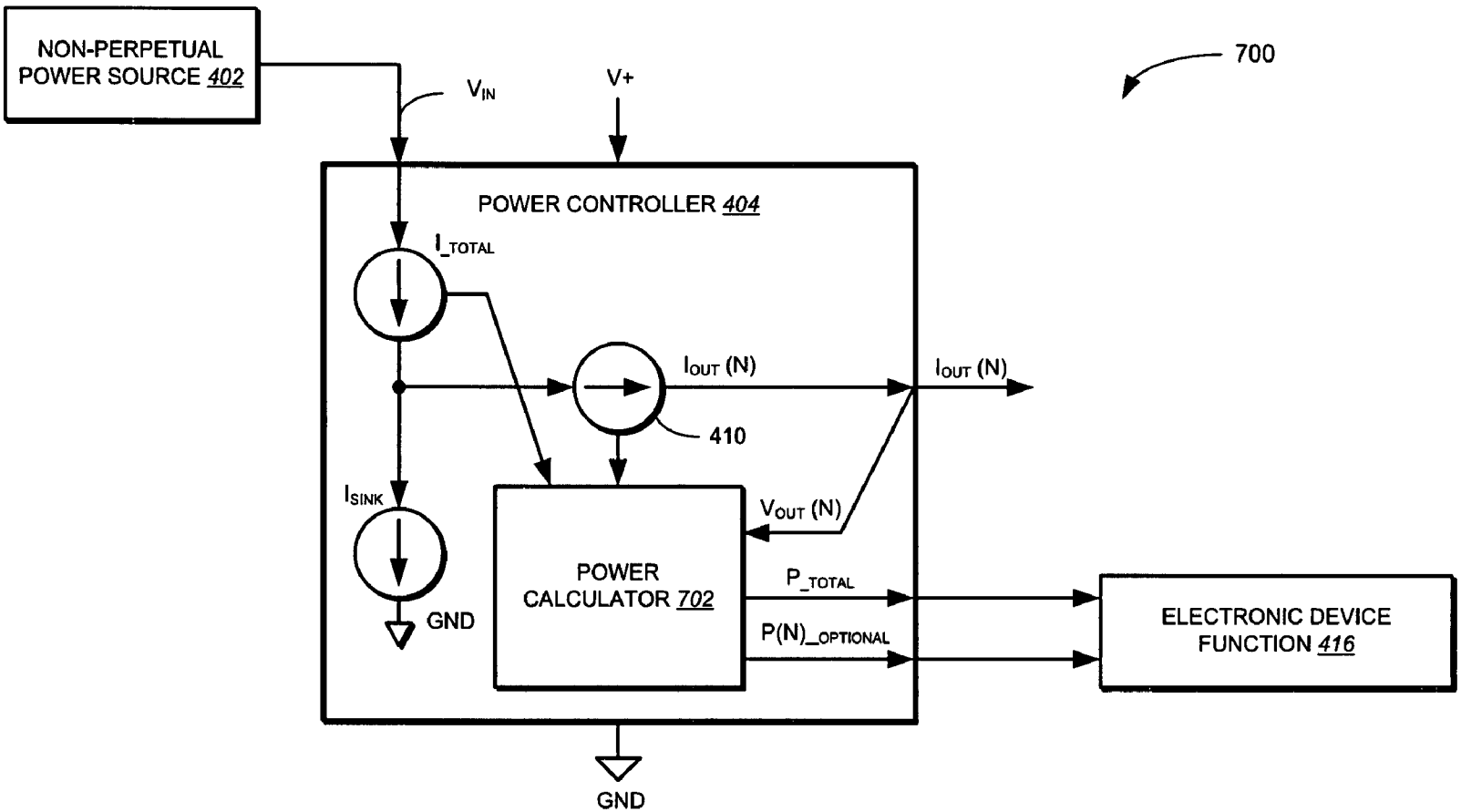
FIG. 7 is a block diagram of an electronic system including a power controller having a power calculator in accordance with one implementation.

FIG. 7 illustrates one implementation of an electronic system 700 including non-perpetual power source 402 and power controller 404. In the implementation of FIG. 7, the power controller 404 includes a power calculator 702 that is configured to calculate total electrical power consumption $P_{TOTAL}$ of the power controller 404 and send the total electrical power consumption $P_{TOTAL}$ to an external output of the power controller 404. The total electrical power consumption $P_{TOTAL}$ can be determined as based on a total amount of current $I_{TOTAL}$ flowing through the power controller 404 follows:

$$I_{TOTAL}=I_{OUT}(N)+I_{SINK} \quad \text{(eq. 6)},$$

$$P_{TOTAL}=I_{TOTAL}*V_{IN} \quad \text{(eq. 7)}.$$

In one implementation in which the power controller 404 provides a plurality of regulated output currents, the power calculator 702 can calculate an output power consumption $P(N)_{OPTIONAL}$ through each output as follows:

$$P(N)_{OPTIONAL}=I_{OUT}(N)*V_{OUT}(N) \quad \text{(eq. 8)}.$$

The calculated power values $P_{TOTAL}$, $P(N)_{OPTIONAL}$ can be provided in analog and/or digital form. Accordingly, the electrical power consumption of the power controller 404 and the individual outputs thereof can be monitored to facilitate other functions—e.g., electronic device function 416.

Figure 8A:
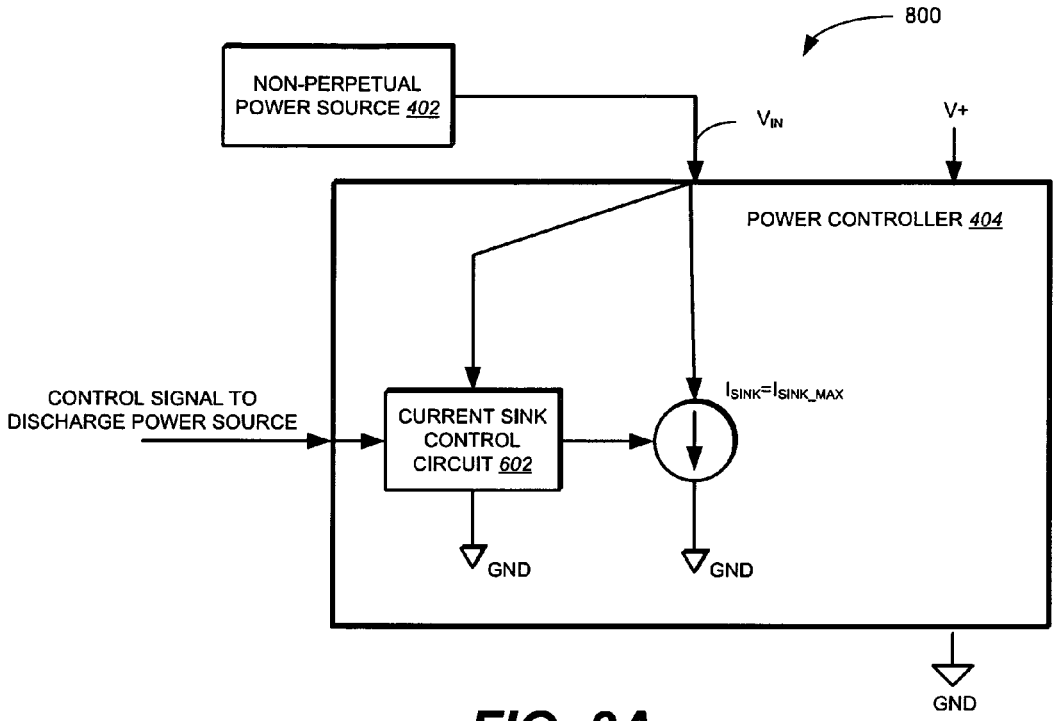
FIG. 8A is a block diagram of an electronic system including a power controller having a current source sink control circuit in accordance with one implementation.
Figure 8B:
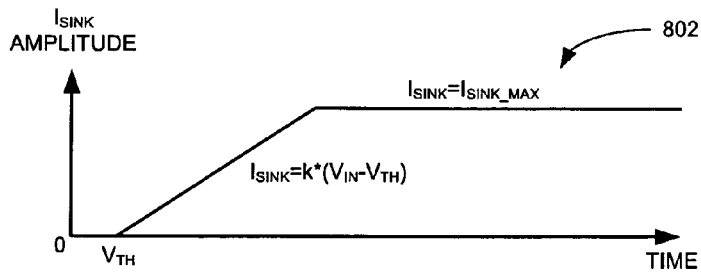
FIG. 8B is a graph of a current source sink to dissipate power input to the power controller of FIG. 8A.

FIG. 8A illustrates one implementation of an electronic system 800 including non-perpetual power source 402 and power controller 404. In the implementation of FIG. 8A, the power controller 404 includes a current sink control circuit 602 that is configured to completely discharge the variable input voltage $V_{IN}$. For example, during operation, it may become necessary to remove all power being provided by the non-perpetual power source 402. In one implementation, the current sink control circuit 602, in response to an external control signal, ramps the current source sink $I_{SINK}$ to $I_{SINK_MAX}$ (as shown in FIG. 8B) to dissipate all power at input voltage $V_{IN}$. The current sink control circuit 602 can verify that the power at input voltage $V_{IN}$ has been substantially dissipated by making sure that the voltage $V_{IN}$ is substantially 0V or GND.

Figure 9:
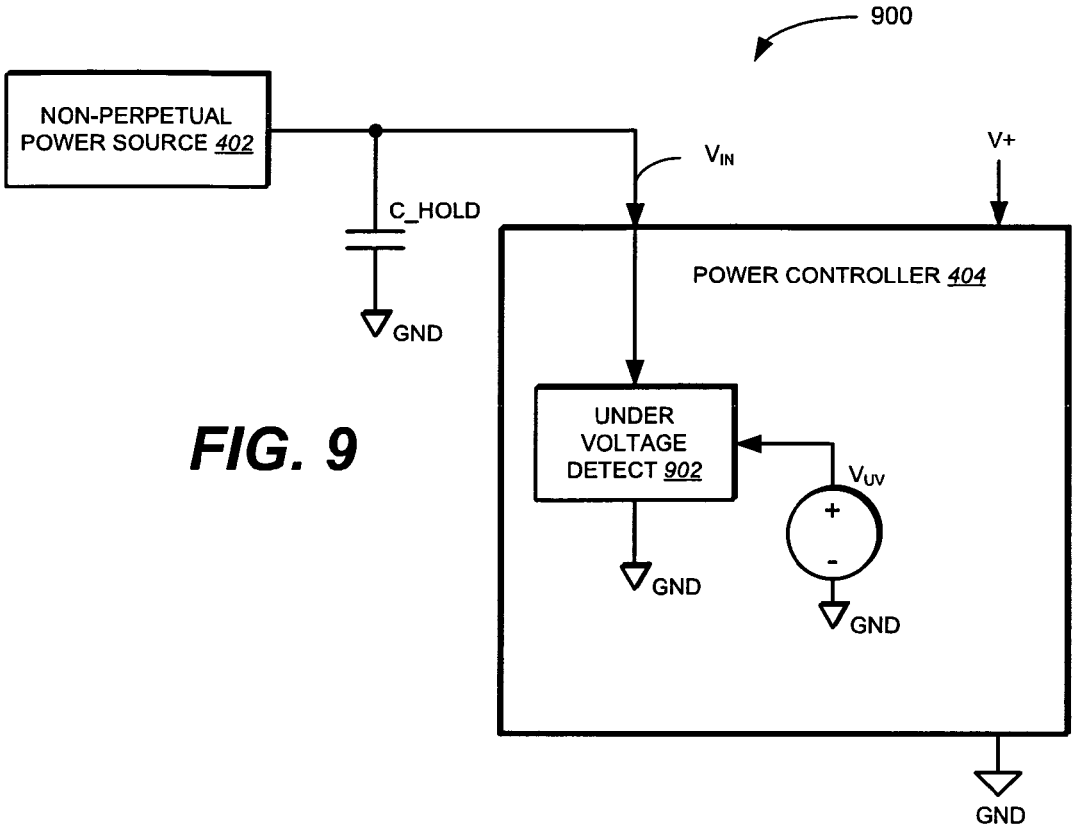
FIG. 9 is a block diagram of an electronic system including a power controller having a under voltage detect in accordance with one implementation.

FIG. 9 illustrates one implementation of an electronic system 900 including non-perpetual power source 402 and power controller 404. In the implementation of FIG. 9, the power controller 404 includes an under voltage detect 902 configured to shut down the power controller 404 if the variable input voltage $V_{IN}$ is lower than a pre-determined under voltage $V_{UV}$, as follows:

if $V_{IN}<V_{UV}$, then the power controller 404 is shut off (eq. 9)

if $V_{IN}>=V_{UV}$, then the power controller 404 is remains on (eq. 10).

Figure 10:
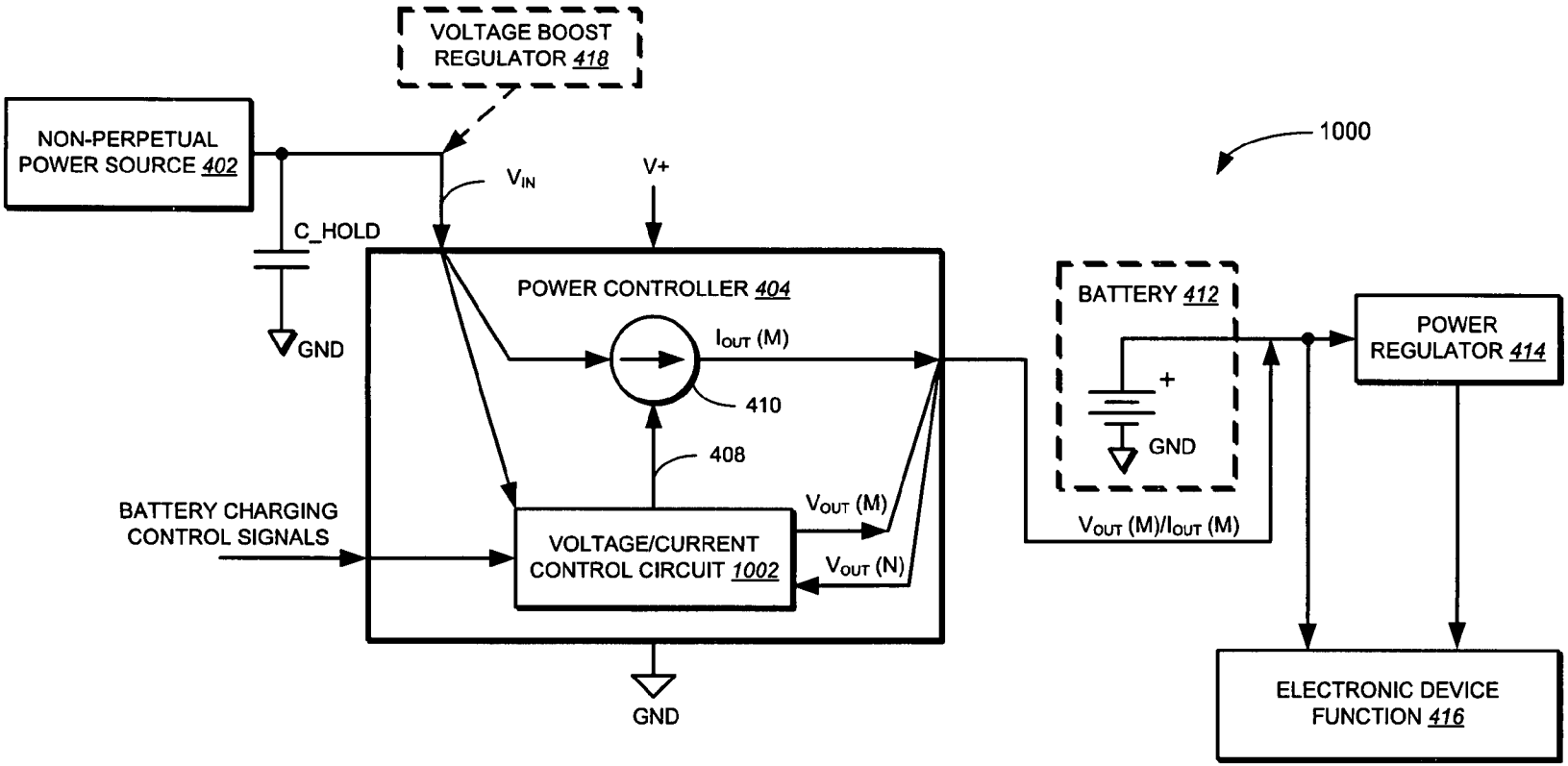
FIG. 10 is a block diagram of an electronic system including a power controller having a voltage/current control circuit in accordance with one implementation.

In this implementation, the voltage at $V_{IN}$ can be used indirectly as indication of the amount of power at the input of the power controller 404. Thus, if there is insufficient power, then the power controller 404 does not operate and, therefore, does not consume any power present at $V_{IN}$. In one implementation, power generated by the non-perpetual power source 402 while the power controller 404 is shut off is accumulated in a storage (e.g., a holding capacitor). For example, the power can be stored in capacitor $C_{HOLD}$ FIG. 10 illustrates one implementation of an electronic system 1000 including non-perpetual power source 402 and power controller 404. In the implementation of FIG. 10, the power controller 404 includes a voltage/current control circuit 1002 and is configured to output a regulated output voltage $V_{OUT}(M)$ and a regulated output current $I_{OUT}(M)$ based on the variable input voltage $V_{IN}$ and the output voltage $V_{OUT}(N)$. In one implementation, the output voltage $V_{OUT}(M)$ and the output current $I_{OUT}(M)$ are regulated for proper charging of one or more batteries (e.g., battery 412). As shown in FIG. 10, the electronic system 1000 includes a (holding) capacitor $C_{HOLD}$ connected between the input $V_{IN}$ of the power controller 404 and ground (GND). Therefore, the amplitude of the variable input voltage $V_{IN}$ and the value of the capacitor $C_{HOLD}$ determines how much electrical charge (Q) is stored and available for charging of the battery 412. Some examples of ideal equations for battery charging include:

$Q=C*V$, Charge equals Capacitance multiplied by Voltage (eq. 11)

$P=V*I$, Power equals Voltage multiplied by Current (eq. 12)

$I=dQ/dt$, Current equals delta Charge divided by delta Time, where delta Charge is the amount of Battery Charge (eq. 13)

$dt=C*(V/I)$, delta Time equals Capacitance multiplied by Voltage divided by Current, where delta Time is the time needed to charge the Battery (eq. 14)

Chemistry behaviors of various types of rechargeable batteries are typically known at the time of manufacture of an electronic device and, therefore, the correct battery charging characteristics (e.g., charging voltage/current amplitude and charging time) are known and can be preset or dynamically programmed into the voltage/current control circuit 1002 (through a battery charging control signal input). For example, battery charging characteristics for lithium-ion batteries are discussed in an article entitled, "*Will Lithium-Ion Batteries Power The New Millenium*", by Isidor Buchmann. Accordingly, the voltage/current control circuit 1002 (within the power controller 404) can calculate (or predict) how much energy is present for charging the battery 412, and the voltage/current control circuit 1002 can be preset or programmed with specific battery charging characteristics associated with the battery 412. Therefore, the following example determinations can be made by the power controller 404: 1) if there is sufficient energy for proper charging of the battery 412, then perform battery charging; 2) if there is insufficient energy for proper charging of the battery 412, then wait for more energy to be accumulated in the holding capacitor $C_{HOLD}$ prior to performing battery charging; and 3) if there is insufficient energy for proper charging of the battery 412, then perform battery charging.

Figure 11:
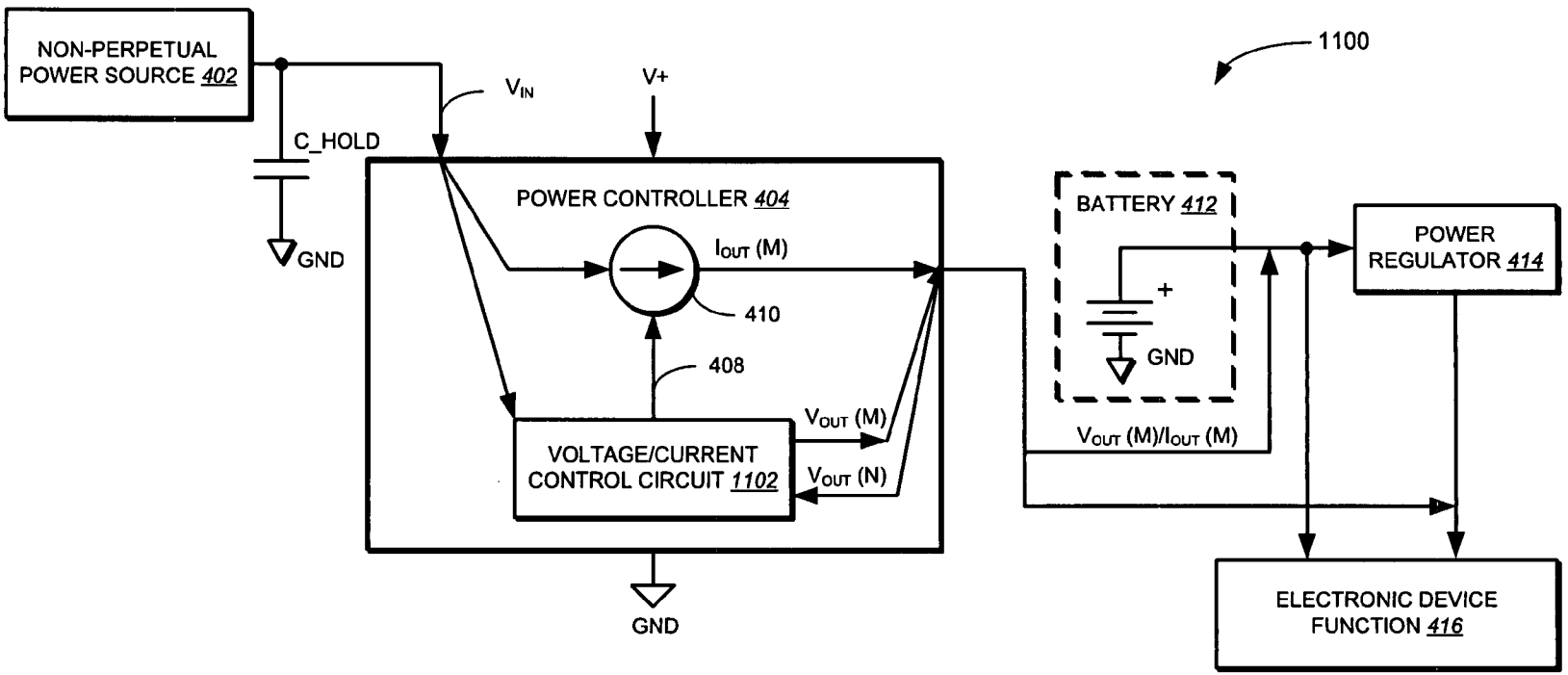
FIG. 11 is a block diagram of an electronic system including a programmable power controller in accordance with one implementation.

FIG. 11 illustrates one implementation of an electronic system 1100 including non-perpetual power source 402 and power controller 404. In the implementation of FIG. 11, the power controller 404 includes a voltage/current control circuit 1102 and is configured to output a regulated output voltage $V_{OUT}(M)$ and/or a regulated output current $I_{OUT}(M)$ based on the variable input voltage $V_{IN}$ and the output voltage $V_{OUT}(N)$. In one implementation, $I_{OUT}(N)$ represents outputs in where only electrical currents are regulated; $V_{OUT}(N)$ represents voltages present at the output of the power controller 404; and $V_{OUT}(M)/I_{OUT}(M)$ are outputs of the power controller 404 that can operate in one of the following three selectable/programmable modes—1) both electrical currents and electrical voltages are regulated; 2) only electrical currents are regulated; and 3) only electrical voltages are regulated, where N and M are non-negative integers ranging from, e.g., 0 to 300. Thus (in one implementation), $V_{OUT}(M)/I_{OUT}(M)$ can operate in all modes if they are connected to rechargeable batteries, $V_{OUT}(M)/I_{OUT}(M)$ can operate only in an electrical current regulated mode if they are connected to non-chargeable batteries, and $V_{OUT}(M)/I_{OUT}(M)$ can only operate in an electrical voltage regulated mode is they are not connected to batteries or voltage regulators. Each $I_{OUT}(N,M)$ can be controlled using any of the methods described above in connection with FIGS. 4A-10. A single power controller (e.g., power controller 404) can, therefore, be used to provide operational and/or electrical charging power to various functions of an electrical device—e.g., the same single power controller can be used in applications that include rechargeable batteries, non-chargeable batteries, or regulators.

Figure 12:
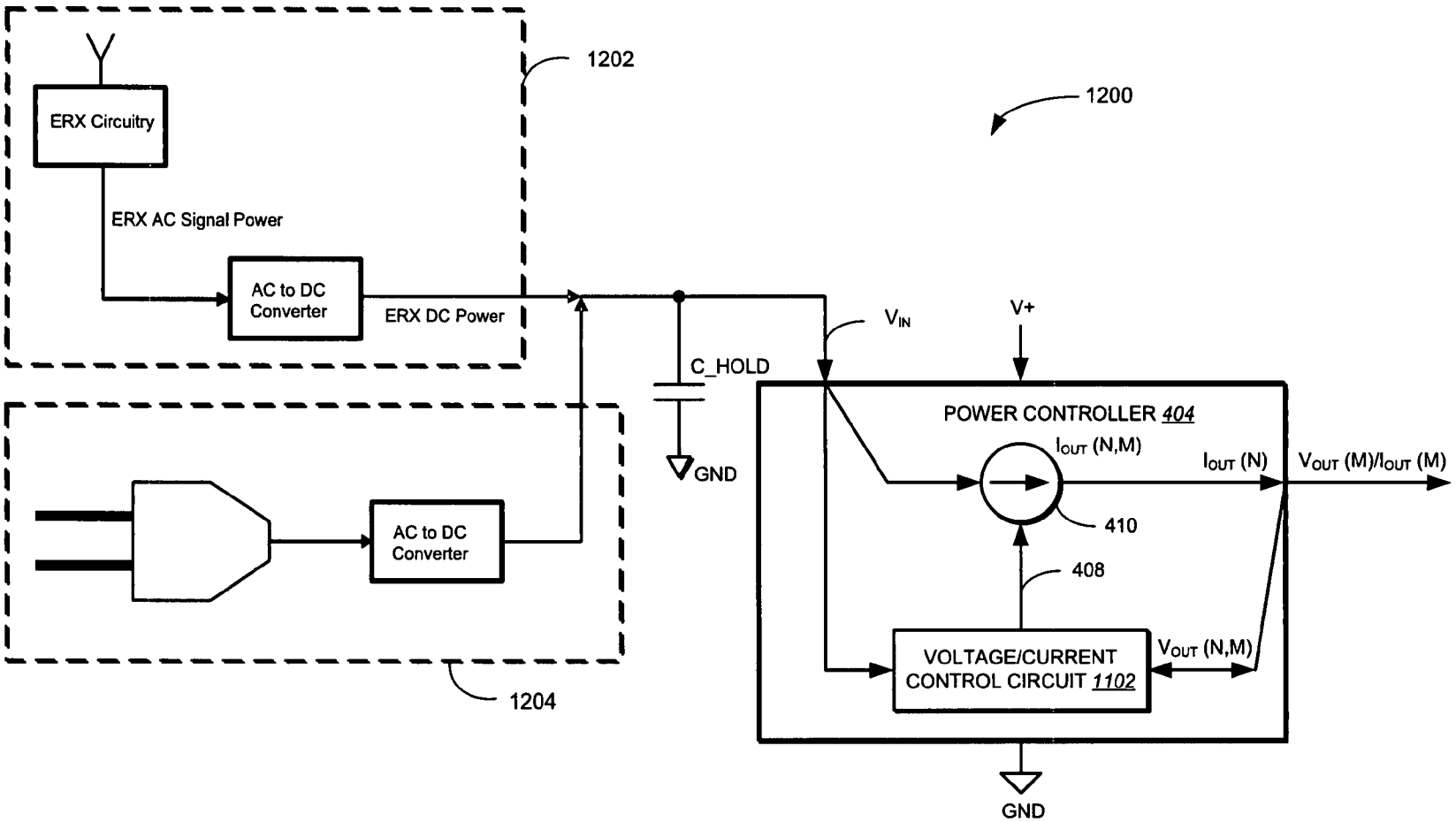
FIG. 12 is a block diagram of an electronic system including a power controller configured to receive power from both a perpetual power source and a non-perpetual power source in accordance with one implementation.

FIG. 12 is a block diagram of an electronic system 1200 including power controller 404 which is configured to receive power from both a non-perpetual power source 1202 and a perpetual power source 1204. The non-perpetual power source 1202 can be an energy receiver as described in application Ser. No. 11/11/857,655, and the perpetual power source 1204 can be, for example, an electrical wall socket. Accordingly, in one implementation, the power controller 404 is configured to generate a regulated output voltage $V_{OUT}$(M) and/or a regulated output current $I_{OUT}$(M) based on the variable input voltage $V_{IN}$ and the output voltage $V_{OUT}$(N), where an amplitude of the variable input voltage $V_{IN}$ is based on a sum of power received from the non-perpetual power source 1202 and the perpetual power source 1204. In this implementation, the power controller 404 can safely deliver operational power to an electronic device function (or regulator) and/or power for charging a battery. As shown in FIG. 12, the output of the non-perpetual power source 1202 can be directly shorted to the output of the perpetual power source 1204, and the combined input can be provided as an input $V_{IN}$ to the power controller 404.

Figure 13:
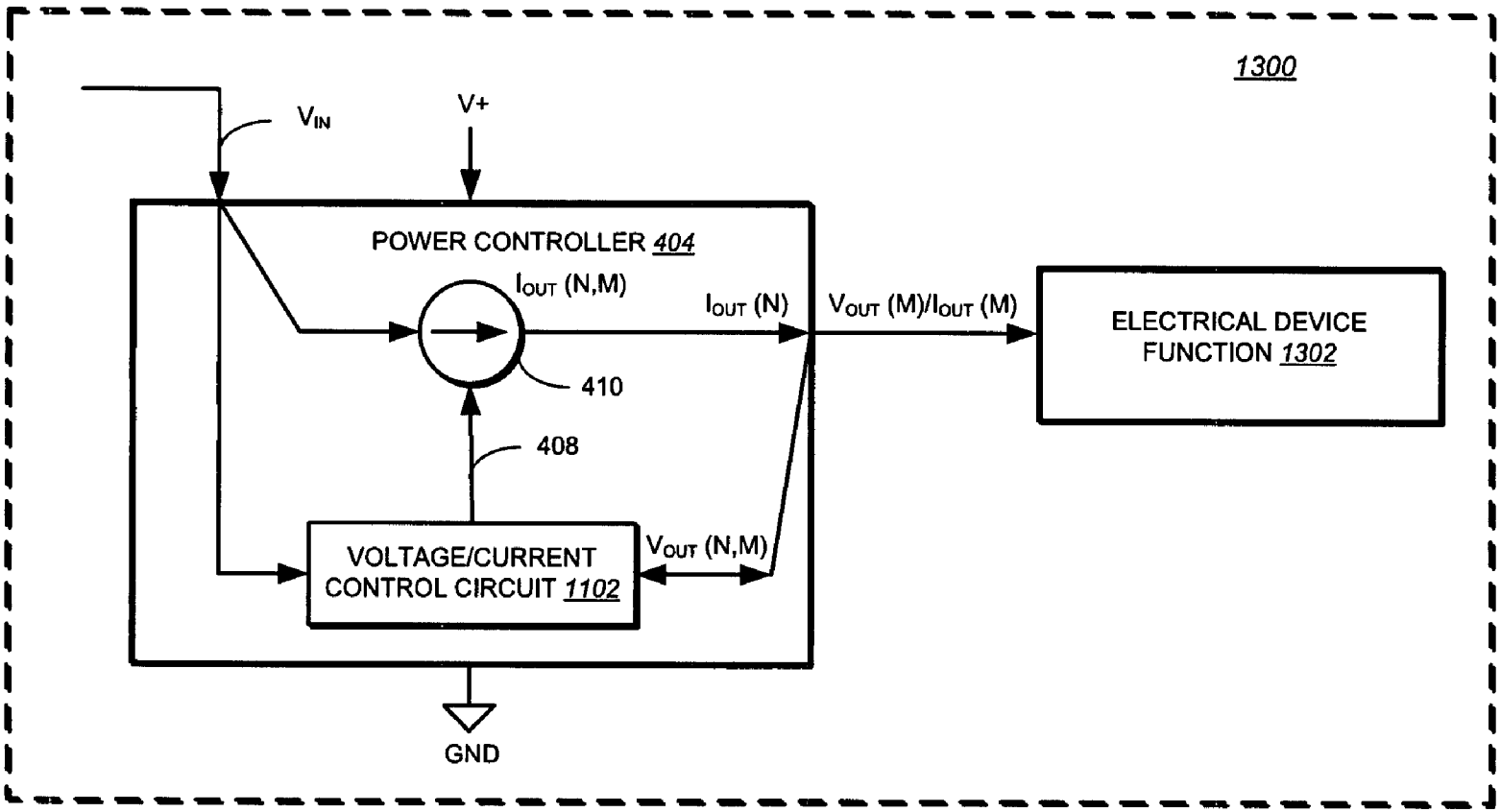
FIG. 13 illustrates a power controller integrated onto a module in accordance with one implementation.

FIG. 13 illustrates one implementation of a module 1300 including power controller 404 and an electrical device function 1302 integrated onto the module 1300. The module 1300 can comprise a single integrated circuit (IC) built on a single substrate. The electrical device function 1302 can be any type of electronic device function that requires electrical current and/or voltage for proper operations—e.g., an analog-to-digital converter, a switching regulator, a linear regulator, a power amplifier, a transceiver, and so on.

Various implementations for regulating power from a non-perpetual power source have been described. Nevertheless, various modifications may be made to the implementations. For example, different combinations of the individual features discussed above in connection with each of the figures can be implemented based on application requirements. In addition, steps of the methods/algorithms described above can be performed in a different order and still achieve desirable results. Accordingly, many modifications may be made without departing from the scope of the following claims.

What is claimed is:

1. A method for regulating electrical power from a non-perpetual power source, the method comprising:

receiving a variable power output from the non-perpetual power source, wherein a power amplitude of the variable power output substantially varies over time;

generating a regulated current output or a regulated voltage output based in part on the variable power output received from the non-perpetual power source;

comparing a voltage amplitude of the variable power output from the non-perpetual power source with a predetermined threshold voltage; and in response to the voltage amplitude of the variable power output being greater than the predetermined threshold voltage, directing electrical current from the non-perpetual power source to ground (GND) to lower the voltage amplitude of the variable power output below the predetermined threshold voltage.

2. The method of claim 1, wherein the non-perpetual power source comprises one or more of an energy receiver, a light energy converter system, a physical motion energy-to-power converter system, or a heat energy-to-power converter system.

3. The method of claim 1, wherein generating the regulated current output or the regulated voltage output further comprises generating the regulated current output or the regulated voltage output based in part on a voltage amplitude associated with the regulated current output or the regulated voltage output.

4. The method of claim 1, further comprising:

receiving a non-varying power output from a non-varying power source, wherein generating the regulated current output or the regulated voltage output includes generating the regulated current output or the regulated voltage output also based in part on the non-varying power output from the non-varying power source.

5. The method of claim 4, wherein the energy storage power source comprises one or more of an electrical outlet or a battery.

6. The method of claim 1, further comprising providing the regulated current output or the regulated voltage output to an output of a power regulator or an output of a battery.

7. The method of claim 1, further comprising providing the regulated current output or the regulated voltage output to an electronic device function.

8. The method of claim 7, wherein the electronic device function comprises a component of an electronic device that requires power to operate.

9. The method of claim 8, wherein the component comprises an analog-to- digital converter, a switching regulator, a linear regulator, a power amplifier, or a transceiver.

10. The method of claim 7, further comprising:

receiving a control signal from the electronic device function, wherein generating the regulated current output or the regulated voltage output includes generating the regulated current output or the regulated voltage output also based in part on the control signal from the electronic device function.

11. The method of claim 7, further comprising:

calculating a total amount or a partial amount of power being consumed based on the variable power output from the non-perpetual power source; and providing the total amount or the partial amount of power being consumed to the electronic device function.

12. The method of claim 1, further comprising:

comparing a voltage amplitude of the variable power output from the non-perpetual power source with a predetermined under voltage; and in response to the voltage amplitude of the variable power output being lower than the predetermined under voltage, ceasing to generate the regulated current output or the regulated voltage output.

13. The method of claim 1, further comprising storing electrical charge associated with the variable power output from the non-perpetual power source in a capacitor.

14. The method of claim 1, wherein generating a regulated current output or a regulated voltage output comprises safely ramping up the regulated current output or the regulated voltage output.

15. An electronic system comprising:

a non-perpetual power source configured to generate a variable power output, wherein a power amplitude of the variable power output substantially varies over time; and a power controller configured to generate a regulated current output or a regulated voltage output based in part on the variable power output received from the non-perpetual power source, wherein the power controller is further configured to:

compare a voltage amplitude of the variable power output from the non-perpetual power source with a predetermined threshold voltage, and in response to the voltage amplitude of the variable power output being greater than the predetermined threshold voltage, direct electrical current from the non-perpetual power source to ground (GND) to lower the voltage amplitude of the variable power output below the predetermined threshold voltage.

16. The electronic system of claim 15, wherein the power controller comprises one or more of a current regulator, a voltage regulator, or a battery charger.

17. The electronic system of claim 15, further comprising:

a non-varying power source configured to generate a non-varying power output, wherein the power controller is further configured to generate a regulated current output or a regulated voltage output based in part on the non-varying power output from the non-varying power source.

18. The electronic system of claim 15, wherein the non-perpetual power source comprises one or more of an energy receiver, a light energy converter system, a physical motion energy-to-power converter system, or a heat energy-to-power converter system.

19. The electronic system of claim 15, wherein the power controller is integrated onto an integrated circuit (IC) module including one of an analog-to-digital converter, a switching regulator, a linear regulator, a power amplifier, or a transceiver.

* * * * *